United States Patent [19]

Laiterä

[11] Patent Number: 4,552,084

[45] Date of Patent: Nov. 12, 1985

[54] SUCTION DREDGER

[75] Inventor: Jukka Laiterä, Turku, Finland

[73] Assignee: Oy Wärtsilä Ab, Helsinki, Finland

[21] Appl. No.: 579,484

[22] Filed: Feb. 13, 1984

[30] Foreign Application Priority Data

Feb. 28, 1983 [FI] Finland ..... 830656

[51] Int. Cl.[4] ..... B63B 25/08

[52] U.S. Cl. ..... 114/74 R; 114/198; 37/58

[58] Field of Search ..... 114/26–38, 114/73, 183 R, 184, 212, 197, 198, 74 R; 414/140, 143; 37/54–59, 68; 210/118, 163, 248, 256, 278, 288, 609; 137/544, 577; 251/341, 333, 343, 349, 352, 353, 367

[56] References Cited

U.S. PATENT DOCUMENTS 2,834,520 5/1958 Nyden ..... 251/349

3,770,013 11/1973 Thompson et al. ..... 251/352

4,149,480 4/1979 Brakel ..... 114/26

FOREIGN PATENT DOCUMENTS 112092 12/1940 Australia ..... 114/185

*Primary Examiner*—Jesus D. Sotelo

*Attorney, Agent, or Firm*—John Smith-Hill

[57] ABSTRACT

In a suction dredger or the like, intended for use in ice-filled waters, there is an overflow tube with a stationary lower portion and a vertically movable upper portion. At the lower end of the stationary tube portion, there is a closure member partly covering the end opening of the tube. Also at the lower end of the movable tube portion, there is a closure member, which substantially covers that portion of the lower end opening of the movable tube portion, which corresponds to the portion of the bottom opening of the stationary tube portion being left uncovered by the closure member of the stationary tube portion.

11 Claims, 2 Drawing Figures

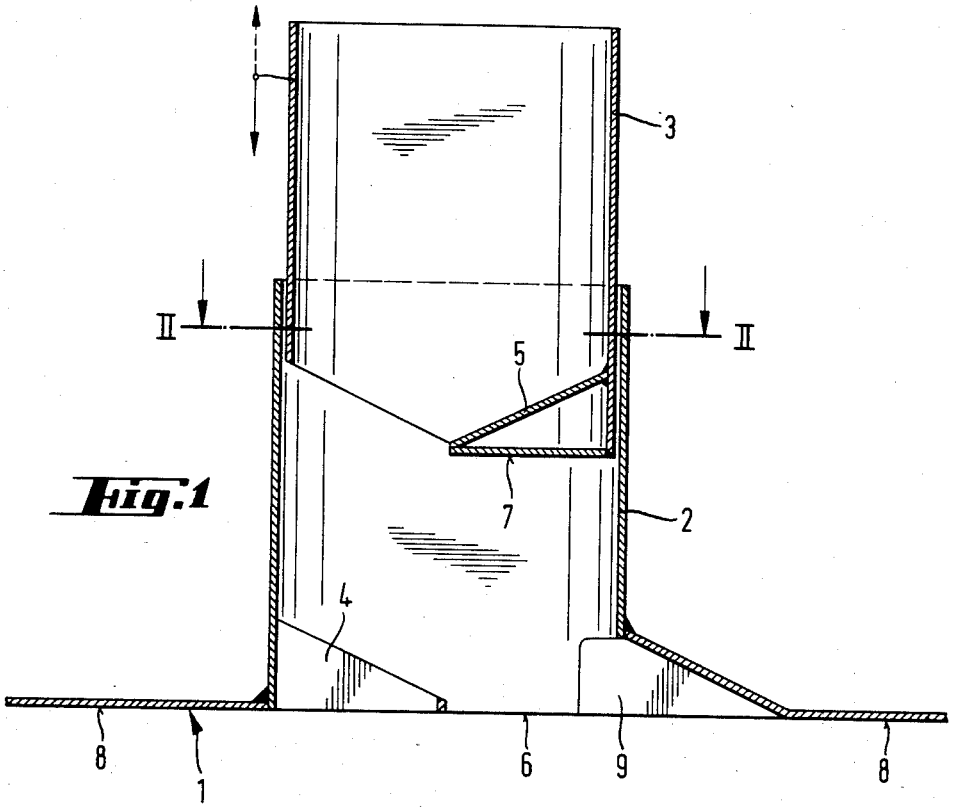
Fig.1
Fig.2
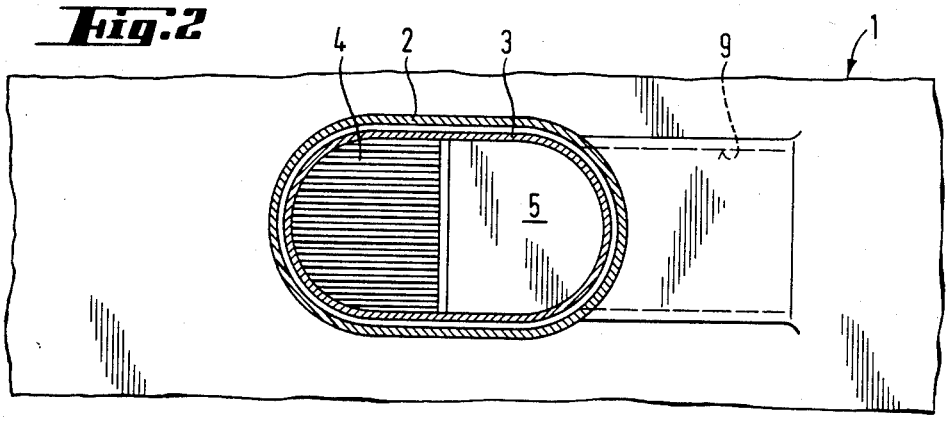

SUCTION DREDGER

The invention relates to an overflow tube in a suction dredger or the like intended to work in ice-filled waters, in which tube there is a stationary lower portion and a vertically movable upper portion. Comparable to a suction dredger is, for instance, a load barge working in connection which a suction dredger, into which barge the flow of material sucked by the dredger is loaded.

The overflow tube of a suction dredger is an important part by means of which the return of sucked water is directed back to the sea, whereas the sucked sand or soil masses remain in the hold of the dredger. The flow rate in the overflow tube may have the general magnitude of 5 $m^3/s$, which means that the tube in question is readlly large. When a suction dredger works in ice-filled waters, ice sludge may fill the lower portion of the overflow tube, because ice blocks and sludge move along the bottom surface of the dredger when the dredger moves through a field of ice sludge. Thereby the ice, due to its buoyancy, tends to accumulate in the bottom opening of the overflow tube. The removing of such accumulated ice is very cumbersome for the reason that the ice sludge particles tend to freeze together, whereby the overflow tube becomes totally clogged. It is not useful to cover the entire bottom opening of the overflow tube with a grid, because ice sludge is able to penetrate also through a rather fine grid. In addition, a grid produces a considerable flow resistance when the full capacity of the tube is used.

The object of the invention is to solve the above mentioned problem so that the overflow tube is sufficiently effectively protected against clogging caused by ice sludge and at the same time is able to function sufficiently effectively as an overflow tube.

When applying the invention, it is suitable to overdimension the overflow tube so that about one half of the cross-sectional area of the tube is sufficient for the desired flow rate. In this way it is made sure that the solutions according to the invention in no case will have any harmful effect on the basic function of the overflow tube.

In a preferred embodiment of the invention, the overflow tube has an elongated cross-section and the closure members according to the invention are at opposite ends of the elongated cross-section. This has proved to be a favourable solution with regard to fluid dynamics. If both closure members cover about one half of the free cross-sectional area of the tube, a symmetric solution is obtained.

When applying the invention, it is feasible, that the stationary or lower tube portion is provided with a closure member, which at the same time forms a grid. This grid can be made with such small apertures, that it will allow only very small amounts of ice to penetrate into the overflow tube. If sufficient amounts of water cannot pass through the grid, the movable portion of the overflow tube can be moved upwards, so that, at the side of the grid, there will be a sufficiently large flow opening. When the movable portion of the overflow tube is in its lowermost position and the closure members of the moving portion and the stationary portion jointly close the bottom opening of the overflow tube, it is possible to maintain a limited flow through the overflow tube via the grid. This situation is feasible at the beginning of the overflow process, when the movable portion of the tube is in its lowermost position and the flow rate is still rather small. The flow rate does not reach its maximum before the water level has risen considerably above the upper edge of the overflow tube.

The closure members according to the invention also function to some extent as flow reducing elements. This influence can be decreased by providing the closure members with one or several flow guiding elements. Such an element may be very simple, for instance, it can be so formed that it makes the upper surface of the closure member slope in a direction towards the flow opening.

The closure members according to the invention by themselves give a rather powerful laterally directed flow guiding influence, the efficiency of which can be increased by using flow guiding elements of the kind mentioned above. The lateral flow can be further increased by providing, at the side of the bottom opening of the overflow tube, a flow guiding surface, for instance, in the form of a wedge-formed depression in the bottom of the dredger. Thereby the advantage is obtained, that the rather powerful flow coming from the overflow tube can be directed towards the side of the dredger, where it has the function of a water flow 1arrying away loose ice blocks. Such a water flow is particularly useful at the position where the suction tube of the suction dredger is connected to the hull of the dredger, because the water flow tends to decrease the load acting on the suction tube due to the presence of loose ice.

The invention will now be described, by way of example, with reference to the accompanying drawing, in which FIG. 1 is an axial section of an overflow tube according to the invention, FIG. 2 is a sectional view taken on the line II—II of FIG. 1.

In the drawing, 1 indicates the bottom of a dredger or a loading barge and 2 the stationary lower portion of an overflow tube. An upper tube portion 3 is axially movable in tube 2. In the lower portion of tube 2, there is a closure member 4, and in the lower portion of tube 3, a closure member 5. These closure members jointly close the bottom opening 6 of the overflow tube when the upper tube 3 is in its lowermost position, whereby the bottom surface 7 of closure member 5 is level with the bottom surface 8 of the dredger.

In the embodiment shown, closure member 4 is a grid formed by vertical plates. This makes it possible to let water flow into the sea through the overflow tube also when the upper tube 3 is in its lowermost position. It is also possible that the closure member 4 of tube 2 is made as a closed member as the closure member 5 of the upper tube 3. Both closure members have an oblique upper surface, the purpose of which is to reduce the flow resistance caused by the closure members. If it is desired that the flow of water from the overflow tube be directed laterally, in FIG. 1 to the right, it is feasible to make, at the lower edge of the overflow tube, opposite to the closure member 4 of lower tube 2, a wedge-formed depression 9 in the bottom surface of the dredger. This tends to considerably influence the lateral direction of the water flow of the overflow tube and this water flow can be used for moving loose ice away from immediate vicinity of the dredger.

The invention is not limited to the embodiment shown, but several modifications thereof are feasible within the scope of the attached claims.

I claim:

1. A watercraft for receiving water and solid material produced in a suction dredging operation, the watercraft having a bottom which bounds an interior space of the watercraft, and comprising a generally vertical overflow tube connected to the bottom of the watercraft and defining a passageway for permitting water to flow from said interior space downwardly out of the watercraft, said overflow tube comprising an outer tube member which has a lower end and an upper end and defines an opening and is secured rigidly at its lower end to the bottom of the watercraft, a first closure member secured to said outer tube member at the lower end thereof and partially blocking the opening defined thereby, an inner tube member which has a lower end and an upper end and defines an opening and is fitted inside the outer tube member and is movable vertically therein between a lower position and an upper position, and a second closure member secured to said inner tube member at the lower end thereof and blocking a part of the opening defined thereby that corresponds to the part of the opening of the outer tube member that is not blocked by the first closure member.

2. An arrangement according to claim 1, in which the cross-sectional area of said overflow tube is so dimensioned with respect to the maximum flow rate intended to pass therethrough, that about one half of the cross-sectional area of said tube is sufficient for obtaining, by means of gravity flow, said maximum flow rate.

3. An arrangement according to claim 1, in which said overflow tube has an elongated cross-sectional form, said first and second closure members being arranged at opposite ends of said elongated cross-sectional form.

4. A watercraft according to claim 1, wherein each of said first and second closure members covers about one half of the free cross-sectional area of said overflow tube.

5. A watercraft according to claim 1, wherein said first closure member includes a grid allowing water to flow therethrough.

6. A watercraft according to claim 1, wherein at least one of said closure members includes means arranged to direct the flow of water in said overflow tube in a direction transverse to the longitudinal axis of said overflow tube.

7. A watercraft according to claim 6, wherein each of said closure members includes means arranged to direct the flow of water in said overflow tube in a direction transverse to the longitudinal axis of said overflow tube.

8. A watercraft according to claim 1, comprising flow guiding means at the outer edge of the lower end of said outer tube member for guiding the flow of water in said overflow tube substantially in the same direction as said first closure member.

9. A watercraft according to claim 1, wherein the first and second closure members together block substantially the entire free cross-sectional area of the overflow tube when the inner tube member is in its lower position.

10. A watercraft according to claim 1, wherein the first closure member has a lower surface that is essentially flush with the bottom of the watercraft, and the second closure member has a lower surface that is essentially flush with the bottom of the watercraft when the inner tube member is in its lower position.

11. A watercraft according to claim 10, wherein the first and second closure members together block substantially the entire free cross-sectional area of the overflow tube when the inner tube member is in its lower position.

* * * * *